US005813149A

United States Patent [19]

Baker et al.

[11] Patent Number: 5,813,149

[45] Date of Patent: Sep. 29, 1998

[54] BOOT WITH REAR EXPANSION FLAP

[75] Inventors: Douglas William Baker, Cincinnati; Freddie L. James, Loveland, both of Ohio

[73] Assignee: 'totes', incorporated, Loveland, Ohio

[21] Appl. No.: 752,576

[22] Filed: Nov. 21, 1996

[51] Int. Cl.[6] ..... A43B 11/00

[52] U.S. Cl. ..... 36/138; 36/7.3; 36/50.1; 36/105

[58] Field of Search ..... 36/7.112, 7.3, 36/4, 50.1, 138, 105

[56] References Cited

U.S. PATENT DOCUMENTS

| | | |
|---|---|---|
| 45,776 | 1/1865 | Watson . |
| 131,199 | 9/1872 | Williams . |
| D. 171,599 | 3/1954 | Hoyt, Jr. . |
| 1,029,772 | 6/1912 | Steuart . |
| 1,604,954 | 11/1926 | Artz . |
| 2,024,766 | 12/1935 | Ingwer . |
| 2,188,603 | 1/1940 | Hamalainen . |
| 2,666,996 | 1/1954 | Odland . |
| 3,621,592 | 11/1971 | Goldmerstein . |
| 4,489,509 | 12/1984 | Libit . |
| 5,144,759 | 9/1992 | Mascotte . |

FOREIGN PATENT DOCUMENTS

| | | |
|---|---|---|
| 111112 | 12/1925 | Switzerland . |
| 437 | of 1875 | United Kingdom . |

*Primary Examiner*—Ted Kavanaugh
*Attorney, Agent, or Firm*—Wood, Herron & Evans, L.L.P.

[57] ABSTRACT

A boot having an expansion flap connected to the rear of a boot leg. The expansion flap is formed to extend generally rearwardly of the boot leg to allow easy ingress and egress of a user's foot into and out of the boot. A biasing device is connected between the expansion flap and the boot leg so as to cause the expansion flap to extend generally rearwardly of the boot leg when the boot is not being worn. A first fastener is carried on the expansion flap, a second fastener is carried on one side wall of the boot leg, and a third fastener is carried on another side wall of the boot leg, the second and third fasteners thereby allowing the expansion flap to be held in wrapped relation against either the one side wall or the other side wall, as selected by the boot's user, when the boot is being worn.

10 Claims, 2 Drawing Sheets

BOOT WITH REAR EXPANSION FLAP

This invention relates to boots.

Boots are very well known to the prior art. A boot basically is a fitted covering of leather or rubber for the foot, and reaches substantially above the ankle. The boot, when it is fabricated of rubber, normally is in the form of an overshoe. The overshoe type boot is meant to be worn over a user's shoe. A boot is basically comprised of a sole which is that part of the boot on which the user treads. The boot also includes an upper which is that part of the boot above the sole, but which usually does not extend above the user's ankle. And finally, the boot comprises a boot leg which is that part of the boot which fits around a wearer's leg, and is above the boot's upper.

A boot is a relatively difficult item of footwear to install on a user's foot. This for the reason that the boot's boot leg usually extends substantially above the wearer's ankle. In order to resolve this problem, it is well known to the prior art to install a gusset in the boot leg along the front vertical edge thereof, and possibly also into the top surface of the boot's upper, so as to provide expansion for the boot leg in order to make it easier for the user to put the boot on and take it off. But the prior art gusset normally tends toward the closed position, i.e., toward the boot wearing position, and so is not open when the user desires to put the boot on. Further, the prior art gusset normally does not tend to open when the fasteners holding it closed are released when the user desires to take the boot off.

Accordingly, it has been a primary objective of this invention to provide a novel boot having an expansion flap connected by a bias device to a boot leg along a generally vertical rear edge of that boot leg, the expansion flap being formed to extend generally rearwardly of the boot leg to allow easy ingress and egress of a user's foot into and out of the boot, respectively, and the bias device causing the expansion flap to extend generally rearwardly of the boot leg when the boot is not being worn so as to make it readily accessible for ingress of a user's foot.

It has been another objective of this invention to provide a novel boot having an expansion flap connected to the boot leg along a generally vertical rear edge of that boot leg for allowing easy ingress and egress of a user's foot into and out of the boot, respectively, in combination with a first fastener carried by the expansion flap, a second fastener carried by an opposite side wall of the boot leg, and a third fastener carried by another side wall of the boot leg, the second and third fasteners being selectively cooperable to hold the flap in wrapped relation against either side wall of the boot leg as desired by the user when the boot is being worn.

Other objectives and advantages of this invention will be more apparent from the following detailed description taken in conjunction with the drawings in which.

Figure 1:
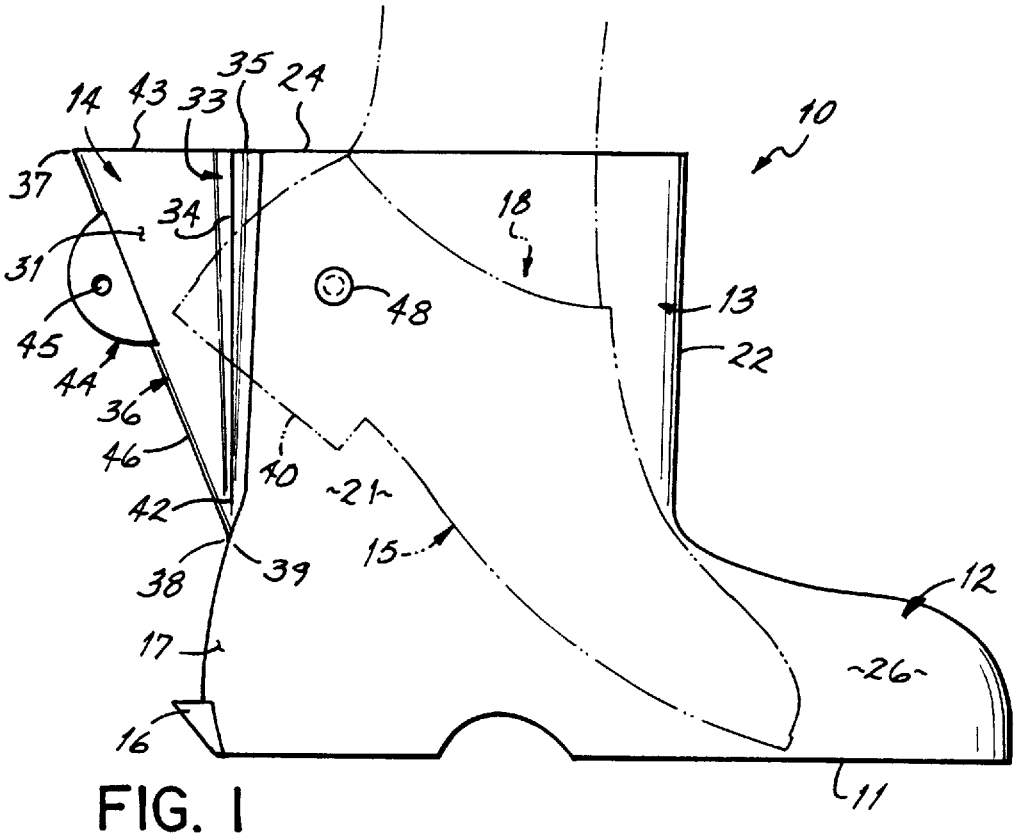
FIG. 1 is a side elevation view of a boot in accord with the principles of this invention.

The boot 10 of this invention is shown in the unfastened or unbuttoned state in FIGS. 1–4. The boot 10 is basically comprised of a sole 11, an upper 12, a boot leg 13, and a boot leg expansion flap 14. The boot 10 preferably is fabricated of rubber, and is sized so as to be fitted over a user's shoe 15. All components of the boot 10 are molded integral one with the other, i.e., the boot's sole 11, upper 12, boot leg 13, and expansion flap 14 are all molded integral one with the other when the boot is made of rubber.

Figure 2:
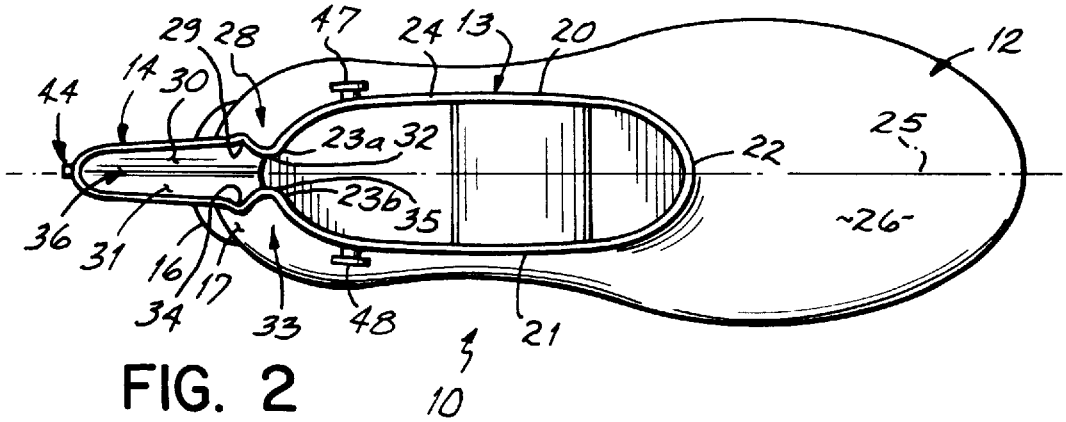
FIG. 2 is a top plan view of the boot shown in FIG. 1.

The boot's upper 12 includes a toe tab 16 extending rearwardly from the upper's heel area 17. This toe tab 16 is adapted to be stepped on by a user's one foot when it is desired to remove the boot 10 from the user's other foot 18 so as to aid in that removal. The boot leg 13 includes one side wall 20, an opposite side wall 21, a generally vertical front edge 22, a generally vertical rear edge 23*a*, 23*b*, and a top edge 24. Each of the boot leg's side walls 20, 21 has an outer surface 13*a*, as shown in FIG. 1. The boot 10, as shown in FIGS. 1 and 2, defines a phantom median vertical plane 25 oriented generally normal to the boot's sole 11. This phantom median vertical plane 25 extends between the toe area 26 and the heel area 17 of the boot's sole 11. That embodiment of the boot 10 illustrated in the figures is generally symmetrical relative to the median vertical plane 25. This means that the boot 10 can be worn either on a user's right foot or a user's left foot. In other words, the user would select either the user's right foot or the user's left foot for use with the boot 10 illustrated in the figures, and that boot not only can be worn by the user on either foot but the expansion flap 14 of that boot can be fastened, as explained in greater detail below, on either the one side wall 20 of the boot leg 13 when it is being worn or the opposite side wall 21 of the boot leg when the boot is being worn, as selected by the user.

Figure 5:
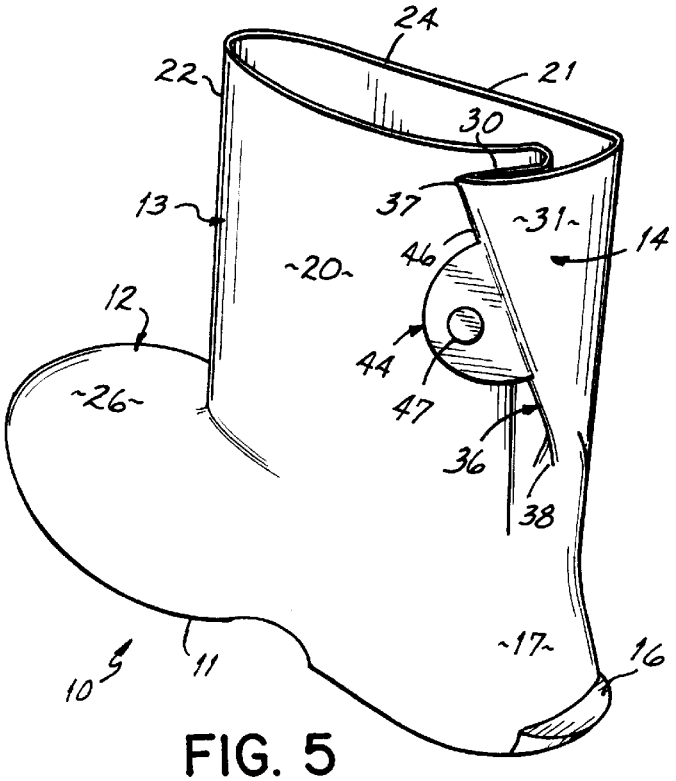
FIG. 5 is a side perspective view of the boot shown in FIG. 1, the expansion flap being fastened in wrapped relation against one side wall of the boot leg.
Figure 6:
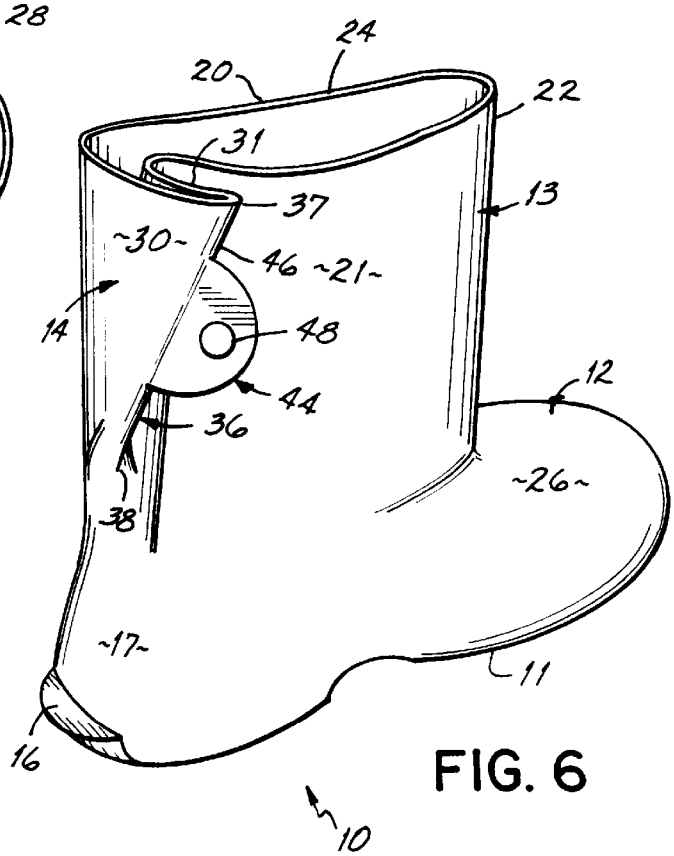
FIG. 6 is a side perspective view of the other side of the boot as shown in FIG. 1, the expansion flap being held in wrapped relation against an opposite side wall of the boot leg.

The boot leg expansion flap 14 is connected to the boot leg 13 along the generally vertical rear edge 23*a*, 23*b* of that boot leg. The expansion flap 14 is formed to extend generally rearwardly of the boot leg 13, as shown in FIGS. 1, 2 and 4, to allow easy ingress and egress of a user's foot 18 into and out of the boot, respectively. A first bias device in the form of a first gusset 28 is connected between the front edge 29 of one 30 of the expansion flap's side walls 30, 31, and one side wall 20 of the boot leg. This first gusset 28 is inwardly directed relative to the boot's interior, and defines a first fold line 32 on which the expansion flap 14 may be folded to wrap the flap against the boot leg's one side wall 20, as shown in FIG. 5, when the boot 10 is being worn. A second bias device in the form of a second gusset 33 is connected to the front edge 34 of the opposite one 31 of the expansion flap's side walls, and the opposite side wall 21 of the boot leg 13. This second gusset 33 also inwardly directed relative to the boot's interior, and defines a second fold line 35 on which the expansion flap may be folded to wrap the flap against the boot leg's opposite side wall 21, as shown in FIG. 6, when the boot 10 is being worn. These bias devices, i.e., these first 28 and second 33 gussets, which are connected between the expansion flap 14 and the boot leg 13 function to cause the expansion flap to extend or flare generally rearwardly of the boot leg when the boot 10 is not being worn so as to make the boot accessible for ingress of a user's foot, all as shown in FIGS. 1–3.

Figure 3:
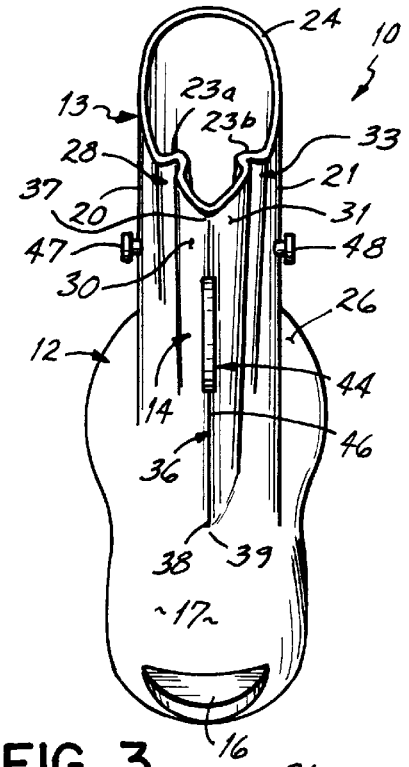
FIG. 3 is a rear perspective view of the boot shown in FIG. 1.
Figure 4:
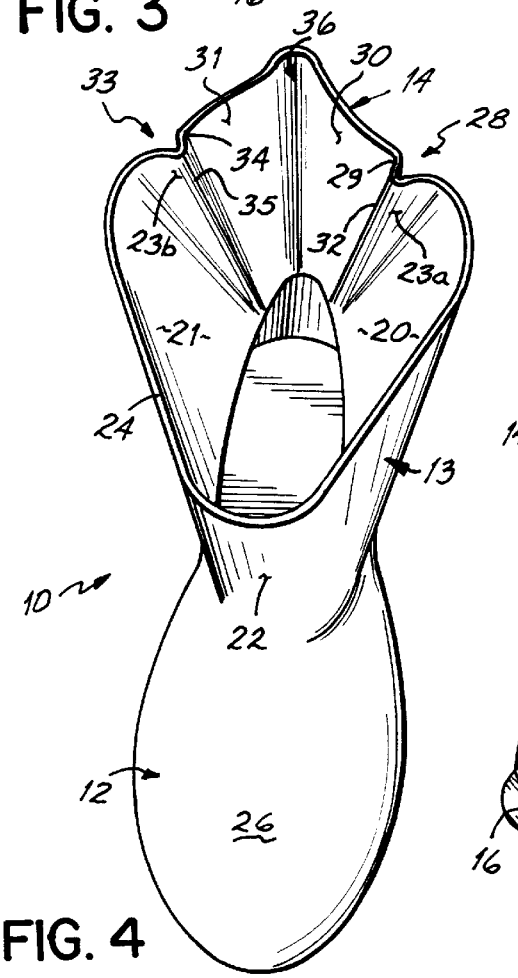
FIG. 4 is a front perspective view of the boot shown in FIG. 1, the boot leg's side walls and boot leg's expansion flap being shown in the open or ready position for easy ingress and egress of a user's foot into and out of the boot, respectively.

The specific structure of the expansion flap 14 is particularly illustrated in FIGS. 1–3. The expansion flap 14 includes opposed side walls 30, 31, and a rear wall 36 connected to the side walls along the rear edges thereof. At its upper end 37 the rear wall 36 is spaced rearwardly from the boot leg's rear edge 23*a*, 23*b* when the boot is not being worn so as to make the boot accessible for ingress of a user's foot. At its lower end 38 the rear wall 36 terminates generally adjacent the upper's top edge 39. As shown in the figures, the rear wall 36 is of a greater width at its lower end 38 and a lesser width at its upper end 37. This rear wall 36, along with its width relationship between its upper 37 and lower 38 ends, presents to some extent a widened slide way for the heel 40 of a user's shoe 15 so as to make easier the ingress and egress of a user's foot into and out of the boot 10. The expansion flap 14, as shown in FIG. 1, is of a generally triangular configuration with the apex 42 of that triangular configuration being located generally adjacent the upper's top edge 39. The base leg 43 of the flap's triangular configuration is located generally adjacent the boot leg's top edge 24.

When the boot 10 is installed on a wearer's foot 18, the expansion flap 14 is wrapped against one side wall 20 or 21 of the boot leg 13 and fastened thereto as illustrated in FIGS. 5 and 6. In this regard, a first fastener in the form of an ear 44 with a hole 45 is fixed to the rear edge 46 of the expansion flap 14. A second fastener in the form of a button 47 is fixed to one side wall 20 of the boot leg 13, the ear 44 and button 47 being selectively cooperable to hold the flap in wrapped relation against that one side wall 20 of the boot leg when the boot 10 is being worn, as shown in FIG. 5. A third fastener also in the form of a button 48 is carried by an opposite side wall 21 of the boot leg 13. The ear 44 and the other button 48 are selectively cooperable to hold the expansion flap 14 in wrapped relation against that opposite side wall 21 of the boot leg 13 when the boot 10 is being worn, as shown in FIG. 6.

In use, and since the boot 10 is generally symmetrical relative to the phantom median vertical plane 25 of it, the boot can be worn by a user on either of the user's two feet as previously noted. With the boot in the non-use position illustrated in FIGS. 1–4, a user's foot 18 is easily accessed into the boot's interior simply by spreading the boot leg's side walls 20, 21 as shown in FIG. 4. This for the reason that the expansion flap 14, due to the presence of the bias devices in the form of first 28 and second 33 gussets, causes the expansion flap to extend generally rearwardly of the boot leg 13 at all times in a ready position when the boot 10 is not being worn. With the user's foot installed inside the boot 10, the user can then elect to wrap the expansion flap 14 in one direction against side wall 20 of the boot leg 13 as shown in FIG. 5, or in the other direction against side wall 21 of the boot leg as shown in FIG. 6. The wrap direction for the expansion flap 14 is simply left to the discretion of the wearer. This allows the wearer to wrap the expansion flap 14 against the inside of each of his legs, or against the outside of each of his legs, or against the inside of one of his legs and the outside of the other of his legs, as the wearer prefers. After so wrapping the expansion flap 14, then it is fastened to that side of the wearer's leg selected by the wearer through use of the first button 47 or second button 48 with the ear's hole 45 as required.

Having described in detail the preferred embodiment of my invention, what I desire to claim and protect by Letters Patent is:

1. A boot comprising a sole, an upper connected to said sole, a boot leg connected to said upper, said boot leg having opposed boot leg side walls, a boot leg expansion flap having opposed flap side walls connected to said boot leg side walls along a generally vertical rear edge of said boot leg, said expansion-flap being flexibly extendable generally rearwardly of said boot leg to allow easy ingress and egress of a user's foot into and out of said boot, respectively, said expansion flap also being flexibly wrappable against one side wall of said boot leg when said boot is being worn, and bias means connected between said expansion flap and said boot leg, said bias means causing said expansion flap to extend generally rearwardly of said boot leg when said boot is not being worn so as to make said boot accessible for ingress of a user's foot, said bias means comprising a resilient gusset connected between the front edge of each flap sidewall and its related boot leg sidewall, said gussets defining opposed fold lines on which said expansion flap may be folded to wrap said flap against either of said boot leg side walls when said boot is being worn, said resilient gussets also cooperating to cause said expansion flap to flare generally rearwardly of said boot leg when said expansion flap is not wrapped against one side wall of said boot leg.

2. A boot as claimed in claim 1, when viewed in side view said expansion flap having a generally triangular configuration, the apex of said triangular configuration being located generally adjacent said upper's top edge.

3. A boot as claimed in claim 1, the base leg of said triangular configuration being located generally adjacent said boot leg's top edge.

4. A boot as claim in claim 1, said boot comprising a first fastener carried by said expansion flap, and a second fastener carried by one side wall of said boot leg, said first and second fasteners being selectively cooperable to hold said flap in wrapped relation against said one side wall of said boot leg when said boot is being worn.

5. A boot as claimed in claim 4, said boot comprising a third fastener carried by an opposite side wall of said boot leg, said first and third fasteners being selectively cooperable to hold said flap in wrapped relation against said opposite side wall of said boot leg when said boot is being worn.

6. A boot as claimed in claim 5, said first fastener being generally located on the rear edge of said expansion flap.

7. A boot as claimed in claim 5, said boot having a phantom median vertical plane oriented generally normal to said sole and extending between toe and heel areas of said sole, and said boot being generally symmetrical relative to said median vertical plane.

8. A boot as claimed in claim 1, said boot having a phantom median vertical plane oriented generally normal to said sole and extending between toe and heel areas of said sole, and said boot being generally symmetrical relative to said median vertical plane.

9. A boot comprising a sole, an upper connected to said sole, a boot leg connected to said upper, said boot leg having opposed boot leg side walls, a boot leg expansion flap having opposed side walls and connected to said boot leg along a generally vertical rear edge of said boot leg, said expansion flap being connected to said boot leg in both the fastened and unfastened positions, said expansion flap allowing easy ingress and egress of a user's foot into and out of said boot, respectively, bias means connected between said expansion flap and said boot leg, said bias means causing said expansion flap to extend generally rearwardly of said boot leg when said boot is not being worn, and said bias means comprising a first gusset connected between the front edge of one of said flap's side walls and said one side wall of said boot leg, said first gusset defining a first fold line on which said expansion flap may be folded to wrap said flap against said boot leg's one side wall when said boot is being worn, a first fastener carried by said expansion flap, a second fastener carried by one side wall of said boot leg, said first and second fasteners being selectively cooperable to hold said flap in wrapped relation against the outer surface of one side wall of said boot leg when said boot Is being worn, and a third fastener carried by an opposite side wall of said boot leg, said first and third fasteners being selectively cooperable to hold said flap in wrapped relation against the outer surface of said opposite side wall of said boot leg when said boot is being worn.

10. A boot as claimed in claim 9, said bias means comprising a second gusset connected between the front edge of the opposite one of said flap's side walls and another side wall of said boot leg, said second gusset defining a second fold line on which said expansion flap may be folded to wrap said flap against said boot leg's opposite side wall when said boot is being worn.

* * * * *